US007963001B2

(12) United States Patent
Yip

(10) Patent No.: US 7,963,001 B2
(45) Date of Patent: Jun. 21, 2011

(54) DOOR HINGE

(76) Inventor: Johnnie Yip, Rosemead, CA (US)

( * ) Notice: Subject to any disclaimer, the term of this patent is extended or adjusted under 35 U.S.C. 154(b) by 309 days.

(21) Appl. No.: 12/386,862

(22) Filed: Apr. 24, 2009

(65) Prior Publication Data

US 2010/0269303 A1 Oct. 28, 2010

(51) Int. Cl.
*E05D 3/10* (2006.01)

(52) U.S. Cl. ..... 16/374; 16/367; 16/239; 16/246; 16/366; 296/146.11

(58) Field of Classification Search ..... 16/374, 16/367, 242, 235–239, 241, 246, 248, 105, 16/54, 50, 286; 296/146.11, 146.12, 76, 296/96, 146.8; 49/420, 425
See application file for complete search history.

(56) References Cited

U.S. PATENT DOCUMENTS

| | | | | |
|---|---|---|---|---|
| 6,676,193 | B1 * | 1/2004 | Hanagan | 296/146.11 |
| 6,808,223 | B1 * | 10/2004 | Baum et al. | 296/146.12 |
| 6,820,918 | B1 * | 11/2004 | DeBono | 296/146.11 |
| 7,669,288 | B2 * | 3/2010 | Zeilbeck et al. | 16/354 |
| 2003/0213102 | A1 * | 11/2003 | Ham | 16/374 |
| 2004/0244144 | A1 * | 12/2004 | Ham | 16/221 |
| 2005/0204511 | A1 * | 9/2005 | Wohlfarth | 16/367 |
| 2005/0283948 | A1 * | 12/2005 | Hyde | 16/361 |
| 2006/0123592 | A1 * | 6/2006 | Yip | 16/241 |
| 2007/0228763 | A1 * | 10/2007 | Duffy | 296/76 |
| 2008/0083089 | A1 * | 4/2008 | Hoffman | 16/367 |
| 2008/0083090 | A1 * | 4/2008 | Hoffman | 16/367 |
| 2009/0056074 | A1 * | 3/2009 | Chase | 16/321 |

FOREIGN PATENT DOCUMENTS

| | | | |
|---|---|---|---|
| DE | 10059706 | A1 * | 5/2001 |
| DE | 102005039028 | B3 * | 9/2006 |

* cited by examiner

*Primary Examiner* — Chuck Y. Mah
(74) *Attorney, Agent, or Firm* — Clement Cheng

(57) ABSTRACT

A door hinge has a bottom bracket and a bottom bracket mounting rib extends from the bottom bracket. A piston has a piston housing and a piston extension connecting in telescopic connection to the piston housing. The piston housing is connected to the bottom bracket at a bottom bracket mounting rib ball joint. The door bracket extension extends from the door bracket. A connection between the door bracket extension and the piston connector is a door bracket extension ball joint. An intermediate connector is connected to the door bracket at an intermediate door bracket joint, wherein the intermediate door bracket joint is a swivel joint. The top bracket is connected to the intermediate connector at a top bracket axle.

18 Claims, 6 Drawing Sheets

DOOR HINGE

DISCUSSION OF RELATED ART

Application Ser. No. 11/014,022 for Adjustable Hinge For A Motor Vehicle filed Dec. 15, 2004 by the inventor Johnnie Yip relates to a front door car hinge, the disclosure of which is incorporated herein by reference. In the previous application, the inventor explained that motor vehicles such as automobiles, typically have a door that rotates horizontally about a hinge. Other hinges with scissor type opening doors have also been developed, but are much less conventional. As seen in the prosecution history of application Ser. No. 11/014,022, a wide variety of door hinge mechanisms have been developed for automobile applications.

SUMMARY OF THE INVENTION

The present invention has several moving parts which are all preferably made of metal such as steel. A bottom bracket is secured to a automobile frame at a lower portion of the door hinge mounting. The bottom bracket is connected to a piston. A piston has a piston housing and a piston extension connecting to a piston connector. The piston connector is connected to a door bracket. A door bracket mounts to a door and is connected to an intermediate connector. The intermediate connector is connected to a top bracket. A top bracket is secured to an automobile frame at an upper portion of the door hinge mounting. The moving parts have joint connection between them.

The bottom bracket is connected to the piston housing at a piston base via a ball joint. The piston is connected to the piston extension by a telescopic configuration. The piston connector is connected to the door bracket by a ball joint. The door bracket is connected to an intermediate connector at an intermediate connector door bracket joint. The intermediate connector is connected to the top bracket at a top bracket axle.

Figure 1:
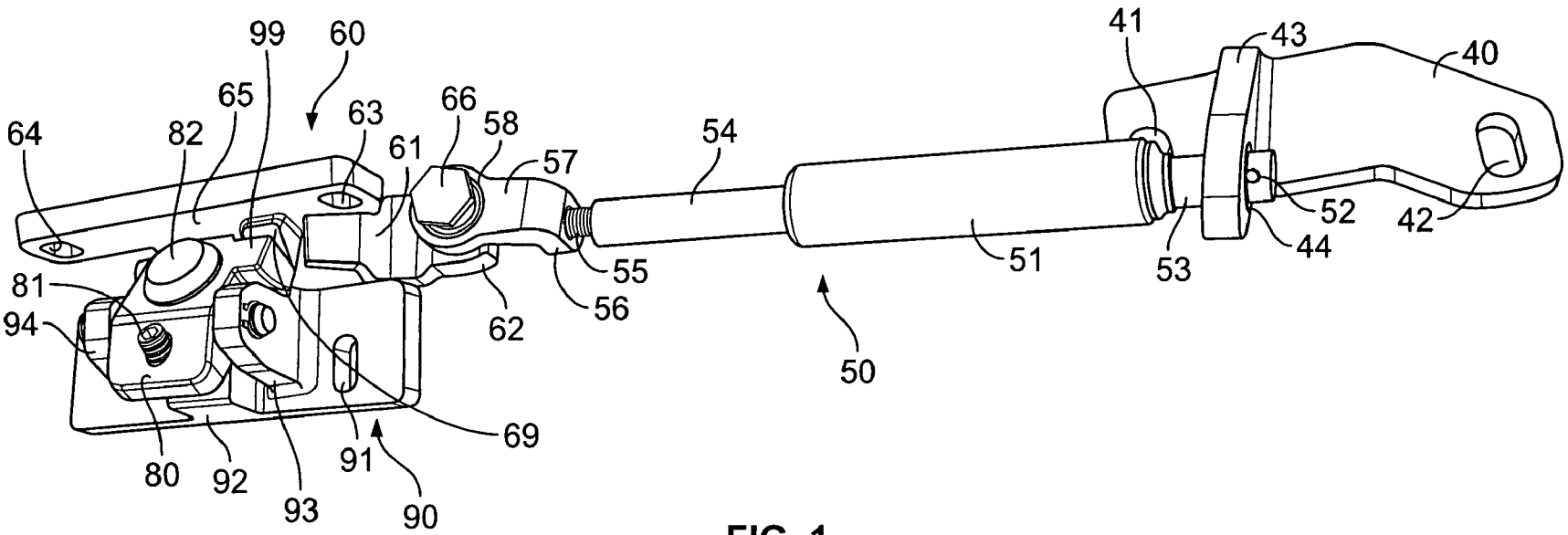
FIG. 1 is a perspective view of the door hinge in an extended position with the upper portion of the apparatus to the right and the lower portion of the apparatus to the left.
Figure 2:
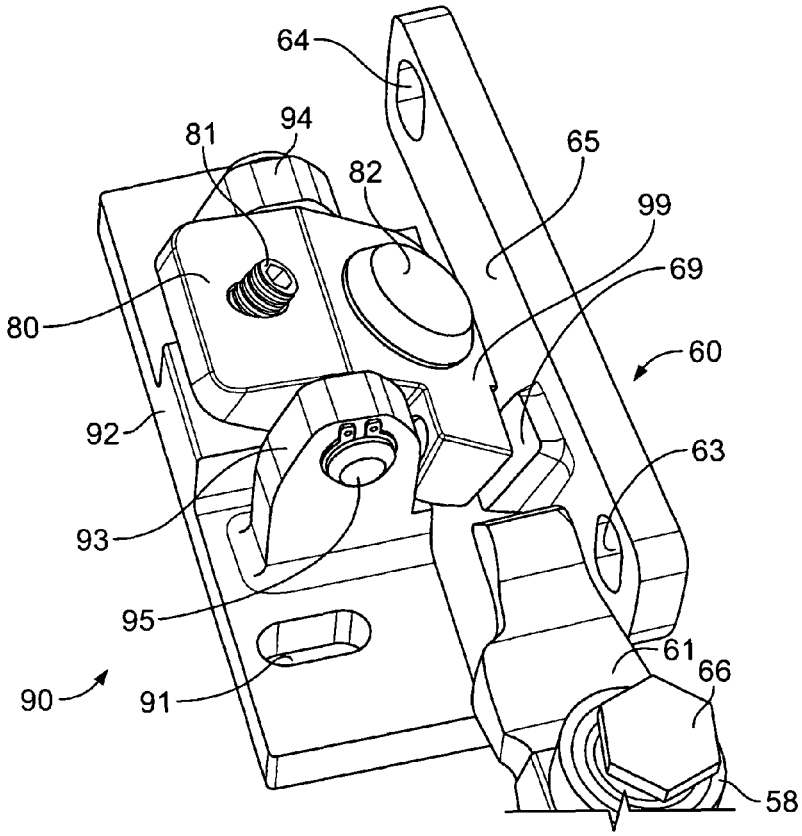
FIG. 2 is a front perspective view of the top hinge.
Figure 3:
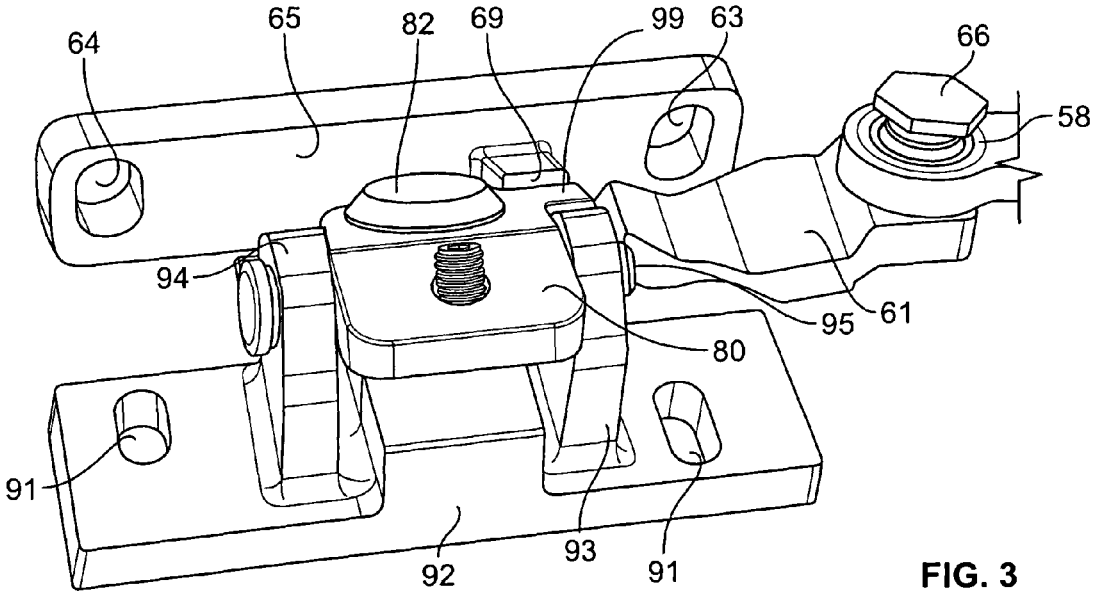
FIG. 3 is a back perspective view of the top hinge.

The following call out list of elements is used consistently to refer to the elements of the drawings as follows:

40 bottom bracket
41 bottom bracket top bolt mount
42 bottom bracket bottom bolt mount
43 bottom bracket mounting rib
44 bottom bracket mounting rib ball joint
50 piston
51 piston housing
52 piston base retainer
53 piston base
54 piston extension
55 piston extension threading
56 piston connector tip
57 piston connector
58 piston connector socket

60 door bracket
61 door bracket extension
62 door bracket extension tip
63 door bracket bottom bolt mount
64 door bracket top bolt mount
65 door bracket flat face
66 door bracket extension ball joint
68 door bracket tongue
69 door bracket platform
80 intermediate connector
81 intermediate connector first stopper
82 intermediate connector door bracket joint
83 intermediate connector door bracket joint aperture
84 intermediate connector second stopper
90 top bracket
91 top bracket bolt mount
92 top bracket platform
93 top bracket lower mounting rib
94 top bracket upper mounting rib
95 top bracket axle
99 intermediate connector protrusion

DETAILED DESCRIPTION OF THE PREFERRED EMBODIMENTS

The bottom bracket 40 is preferably made of a thick plate of steel which is cut so that there is a bottom bracket top bolt mount 41 and a bottom bracket bottom bolt mount 42. The bottom bracket top bolt mount 41 is preferably shaped as a pill shaped slot above the bottom bracket bottom bolt mount 42 which is also preferably shaped as a pill shaped slot. The bottom bracket top bolt mount 41 may further include a horizontal offset from the bottom bracket bottom bolt mount 42. A bottom bracket mounting rib 43 is preferably made of a planar member, such as a thick plate of steel, and welded at a periphery to the bottom bracket 40, between the bottom bracket top bolt mount 41 and the bottom bracket bottom bolt mount 42 so that the bottom bracket mounting rib 43 is in rigid connection with the remainder of the bottom bracket 40. Preferably, the bottom bracket mounting rib 43 is formed as a flange protruding approximately, preferably about a perpendicular angle to the plane of the bottom bracket 40. The bottom bracket 40 is preferably made in a curved profile. The bottom bracket mounting rib 43 further includes an aperture receiving a bottom bracket mounting rib ball joint 44. The bottom bracket mounting rib ball joint is mounted in the bottom bracket mounting rib 43. The bottom bracket mounting rib 43 and its ball joint 44 extends inward toward the bottom of the page as shown on FIG. 1 of the drawings. The bottom bracket mounting rib has a flat or rounded face on an outside side as shown on the top of the page of FIG. 1. The bottom bracket mounting rib 43 thus leans inward exposing a flat area on an outside side.

The bottom bracket mounting rib ball joint 44 is preferably connected to a piston base 53 of a piston 50. The piston base 53 is preferably formed as a cylindrical extension extending from a piston housing 51. The piston base 53 is preferably secured to the bottom bracket mounting rib ball joint 44 by a piston base retainer 52. The piston base retainer 52 can be a pin extending from one face of the piston base 53 to an opposite face of the piston base 53. The pin would thus be in a through extension through the piston base. An aperture in the piston base can receive the pin. Optionally, a clip can retain the pin. The piston base 53 preferably extends through an aperture in the bottom bracket mounting rib 43. A ball joint can be mounted on the bottom bracket mounting rib 43 so that the ball joint becomes the bottom bracket mounting rib ball joint 44. Although the pin may retain the bottom bracket mounting rib ball joint 44 on the piston base 53, optionally, the ball joint can be secured, or unsecured to the piston base 53. The piston base 53 supports the piston housing 51. The piston housing 51 has a telescopic relationship with a piston extension 54. The piston extension 54 is disposed as a rod entering through an aperture of the piston housing 51 so that the piston extension 54 moves in coaxial translation relative to the piston housing 51. The piston housing 51 is biased with gas or spring or both to provide an extension force pushing the piston extension 54 outward away from the piston housing 51. The piston extension 54 has a terminal area opposite the piston housing 51. The terminal area is optionally threaded to form a piston extension threading 55.

A piston connector 57 has a piston connector tip 56 which is bent and threaded at an aperture to receive the piston extension threading 55. The bent piston connector tip 56 has a flat face with an aperture which faces the piston extension threading 55. The piston extension threading 55 can be detached from the piston connector 57 by rotating the piston extension 54. Rotating the piston extension 54 allows removal of the piston for easy replacement if necessary. The piston connector 57 has an upper end with an aperture. The preferably circular aperture forms a piston connector socket 58 on the piston connector 57.

The door bracket 60 has a door bracket extension ball joint 66. The preferably circular aperture is shaped to receive a ball joint which is the door bracket extension ball joint 66. The door bracket extension ball joint is mounted to the door bracket extension tip 62 so that the piston connector socket 58 receives the door bracket extension ball joint 66. The door bracket 60 has a door bracket extension 61 which is preferably made from a plate of steel welded perpendicular to the door bracket 60, also preferably made from a plate of steel. The perpendicular welding joint occurs at a lower area of the door bracket 60. The door bracket 60 is formed as a planar member with a door bracket flat face 65 and a door bracket bottom bolt mount 63 below a door bracket top bolt mount 64. The door bracket flat face 65 is preferably between the door bracket bottom bolt mount 63 and the door bracket top bolt mount 64. The door bracket extension being perpendicularly welded to the door bracket 60, also further includes a door bracket extension tip 62. The door bracket extension tip 62 forms a planar face perpendicular to the door bracket flat face 65. A ball of a door bracket extension ball joint 66 is preferably mounted on a flat face of the door bracket extension tip 62. The door bracket extension tip 62 extends downward away from the door bracket 60. The door bracket extension tip 62 is attached to the door bracket at a connection or weld which begins on an area on an inside side of the door bracket bottom bolt mount 63. The door bracket extension tip 62 curves around the door bracket bottom bolt mount 63. The door bracket extension tip 62 has at least one fold in it. The door bracket flat face 65 has a door bracket platform 69 protruding as a wedge shaped column from the door bracket flat face 65. The door bracket platform 69 preferably begins above the interface between the door bracket extension tip 62 and the door bracket 60 at a lower half of the door bracket. The door bracket further includes a door bracket tongue 68. The door bracket tongue 68 is bent at an angle to the door bracket flat face 65. The door bracket tongue angle is preferably less than 90°.

Figure 4:
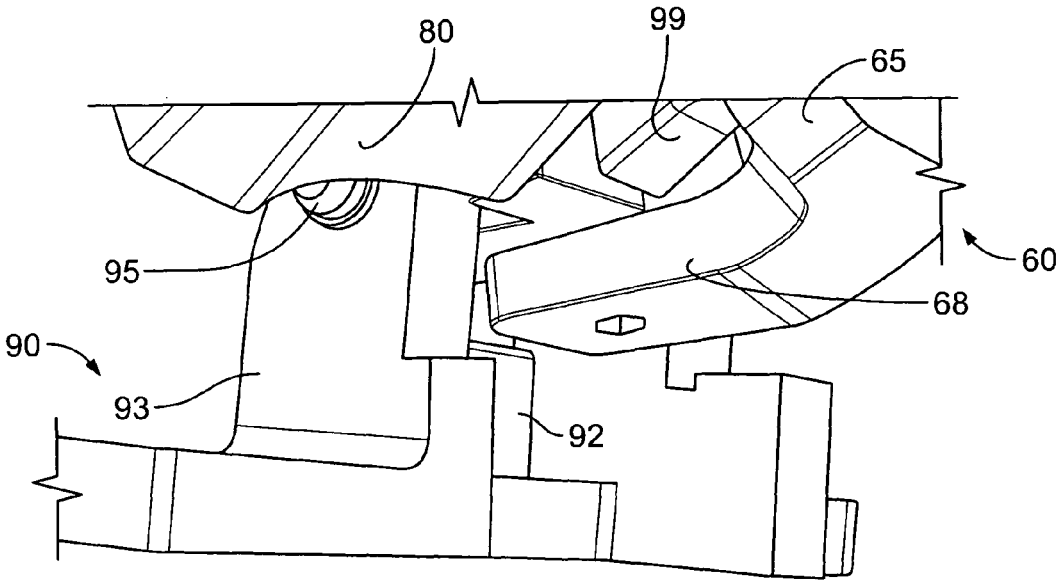
FIG. 4 is a lower perspective side view of the top hinge.
Figure 5:
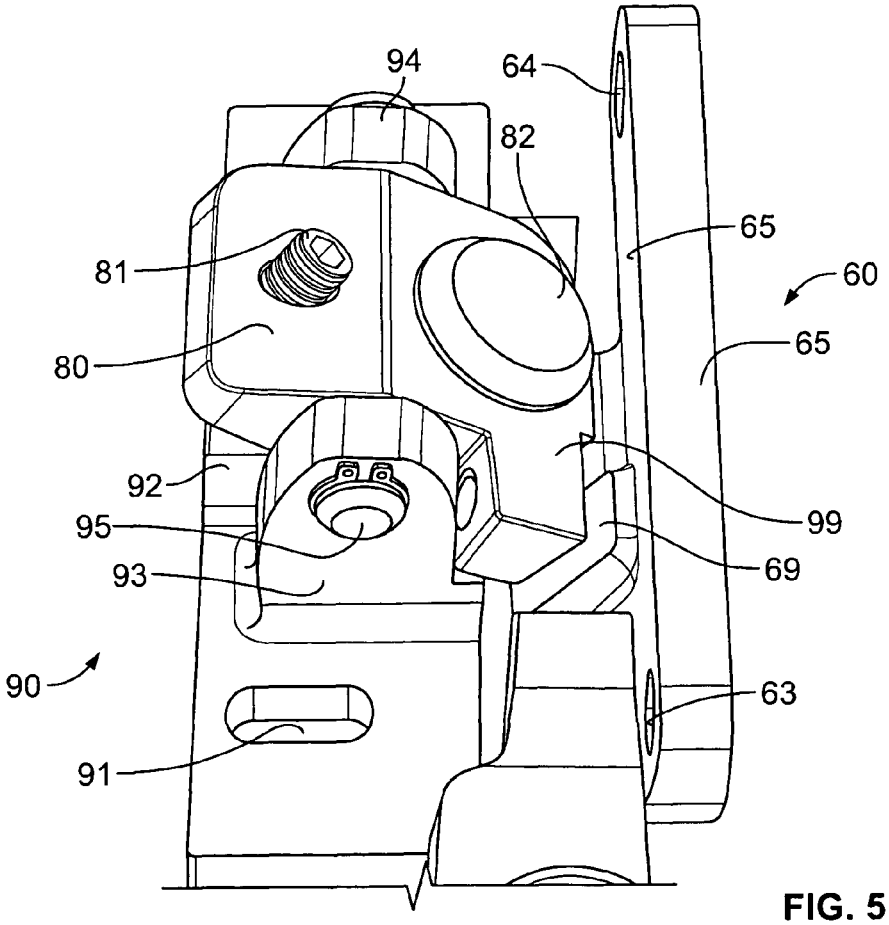
FIG. 5 is a front isometric view of the top hinge.
Figure 6:
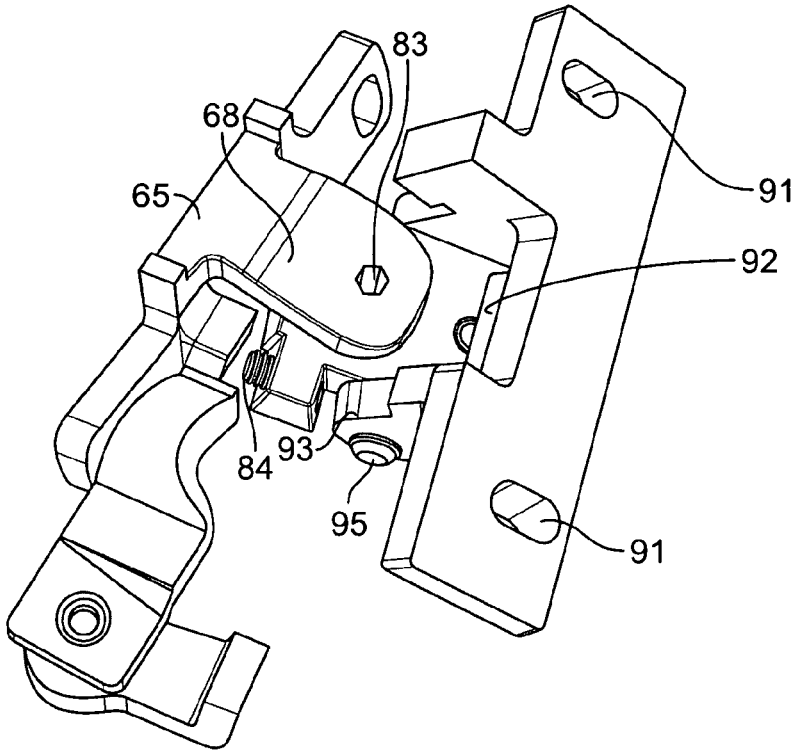
FIG. 6 is a bottom perspective view of the top hinge.
Figure 7:
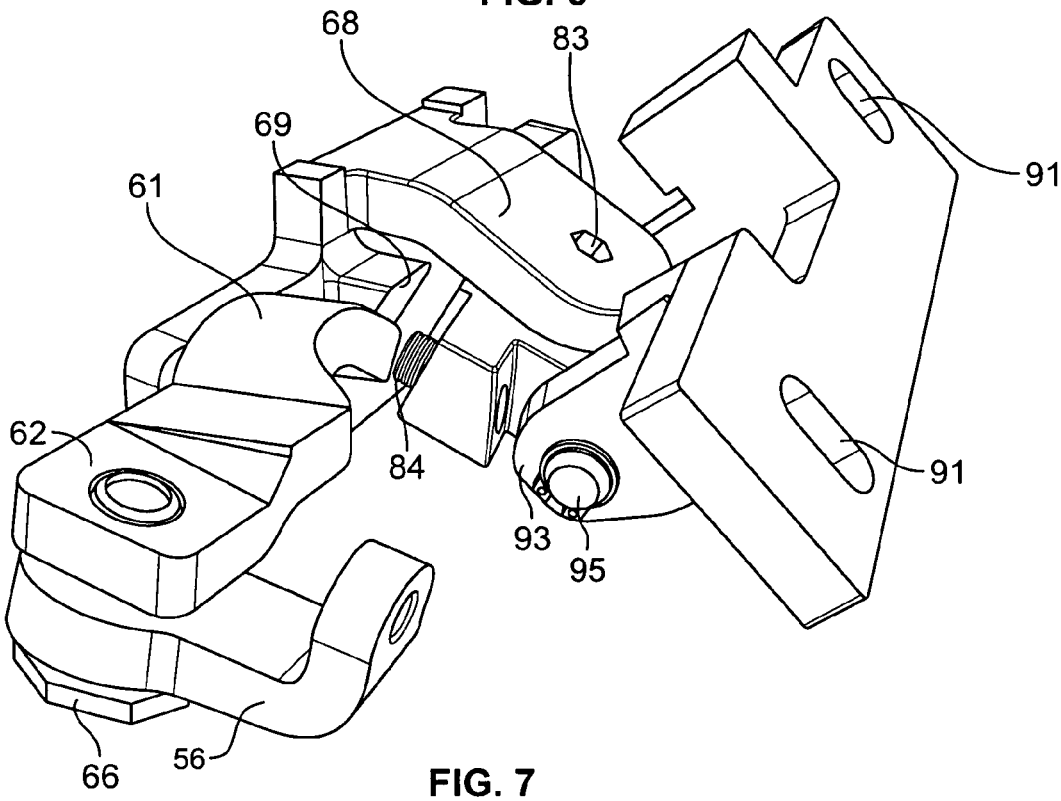
FIG. 7 is a bottom side perspective view of the top hinge.
Figure 8:
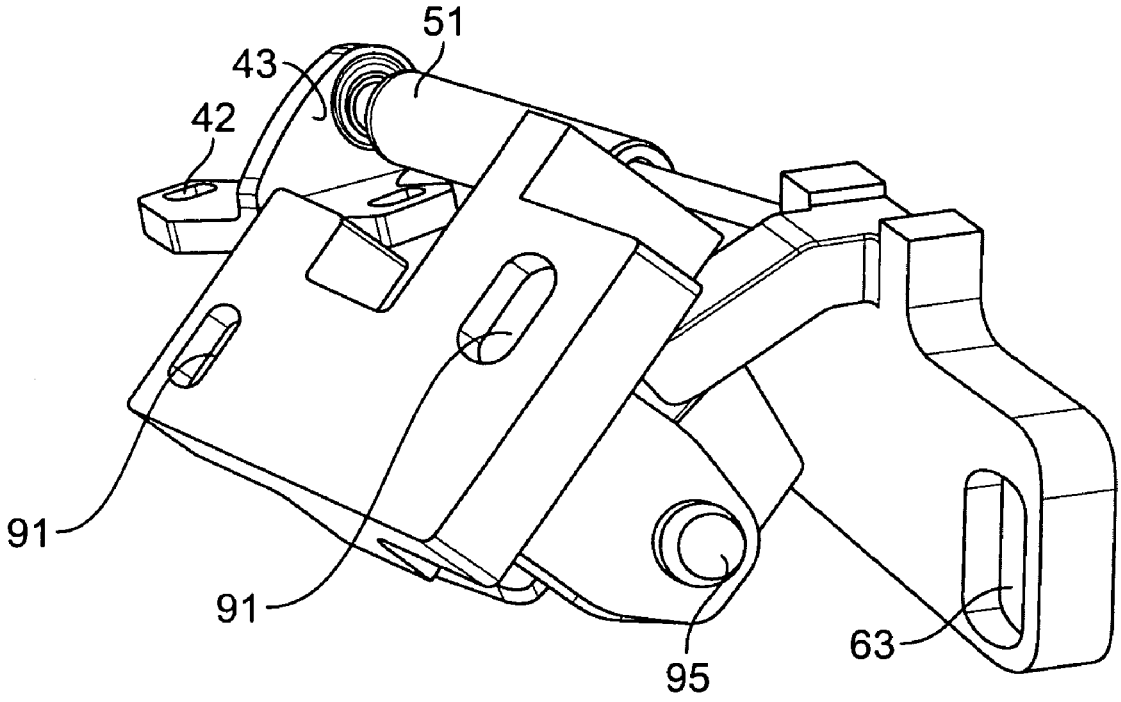
FIG. 8 is an upper perspective view of the top hinge.
Figure 9:
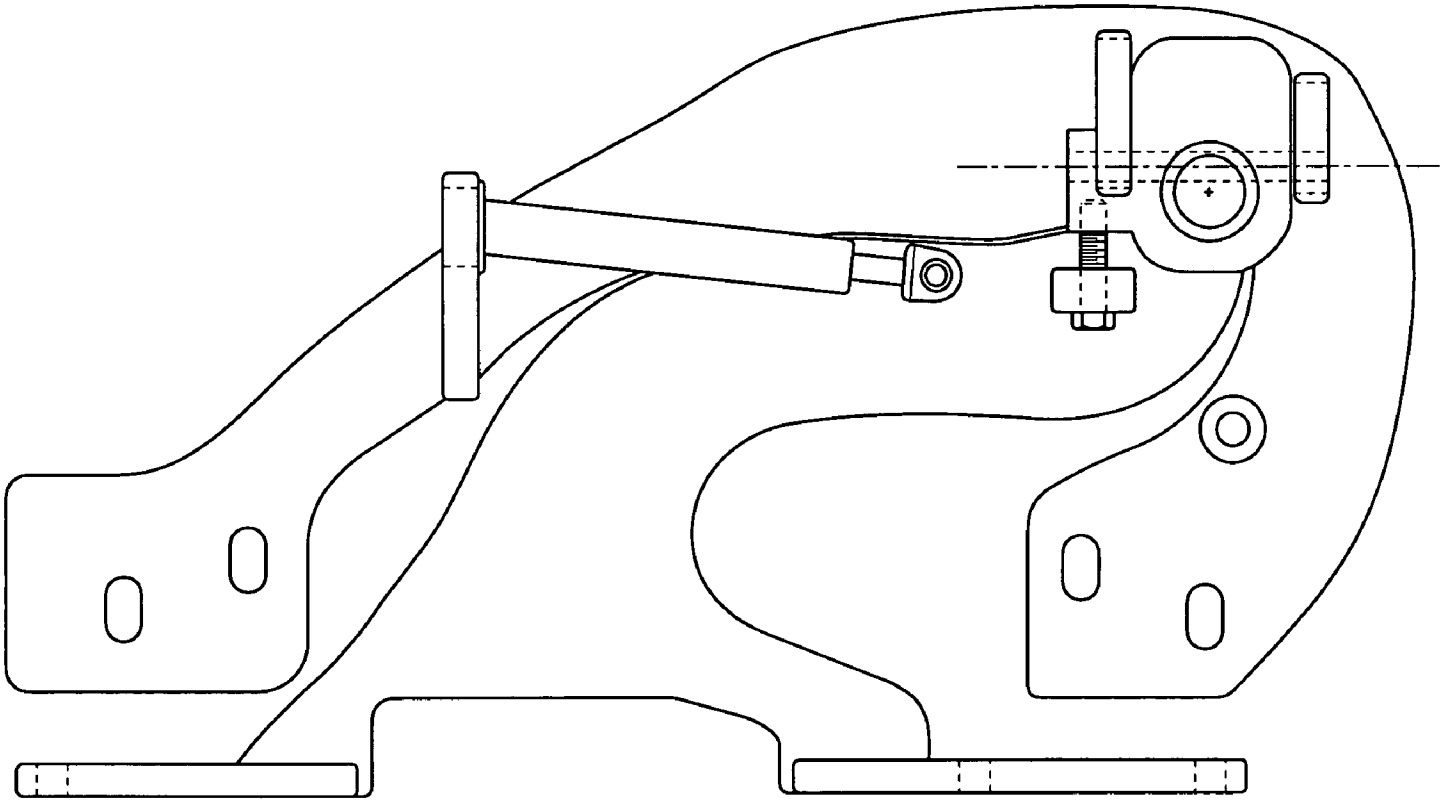
FIG. 9 (Prior Art)
FIG. 9 is a hinge of the prior art.

The intermediate connector 80 has an inside portion and an outside portion that join at a beveled edge extending across a width of the intermediate connector 80 along an interface. The intermediate connector 80 has an intermediate connector door bracket joint 82 on an outside portion which connects to the door bracket tongue 68. The intermediate connector door bracket joint 82 swivels relative to the door bracket tongue 68 on a plane parallel to a surface of the door bracket tongue 68. The door bracket tongue 68 optionally abuts and stops on a top bracket platform 92, FIG. 4. The intermediate connector 80 also has an intermediate connector first stopper 81. The intermediate connector first stopper has a threaded exterior and is shaped as a cylinder. The threaded exterior of the intermediate connector first stopper 81 is in threaded connection with a threaded aperture having threads on an internal surface. The threaded aperture is located on the surface of the intermediate connector 80. The threaded aperture is sized to receive the threaded exterior surface of the intermediate connector first stopper 81. The intermediate connector first stopper 81 may have a hexagonal drive for allowing rotation by a hexagonal screwdriver. The intermediate connector first stopper 81 can be adjusted for stopping against a top bracket platform 92. An intermediate connector protrusion 99 extends from the intermediate connector 80 outside portion. The intermediate connector protrusion 99 preferably abuts the door bracket platform 69. The intermediate connector protrusion 99 may optionally include an aperture for receiving an intermediate connector second stopper 84. The intermediate connector second stopper 84 can have the same physical construction as the intermediate connector first stopper 81 with the hexagonal drive and externally threaded surface. The intermediate connector door bracket joint has an intermediate connector door bracket joint aperture 83, FIGS. 6, 7.

A top bracket 90 can be connected to the intermediate connector 80 using a top bracket axle 95 which passes through the intermediate connector 80 between the inside portion and outside portion of the intermediate connector 80. The top bracket axle 95 can be formed as a cylinder which is held in place by a circle clip received in a groove of the top bracket axle 95. The top bracket axle 95 has an axis of rotation perpendicular to the axis of rotation of the intermediate connector door bracket joint 82. The top bracket axle 95 is structurally supported by a top bracket lower mounting rib 93 and a top bracket upper mounting rib 94. The top bracket lower mounting rib 93 and the top bracket upper mounting rib 94 extend as a pair of flanges protruding approximately perpendicular to the planar level of the top bracket 90. The top bracket lower mounting rib 93 and the top bracket upper mounting rib 94 preferably have rounded exterior portions, and are preferably made of steel plate of approximately the same thickness as the top bracket 90. The top bracket platform 92 is preferably disposed between the pair of top bracket bolts mounts 91. The top bracket lower mounting rib 93 and the top bracket upper mounting rib 94 are preferably disposed between the top bracket bolts mounts. The top bracket platform 92 is preferably disposed between the top bracket lower mounting rib 93 and the top bracket upper mounting rib 94. The top bracket platform 92 can also be made of a portion of steel plate cut to a rectangular block and welded to the top bracket 90. The top bracket platform 92 is preferably placed in a middle area at an inside edge of the top bracket 90, and extending halfway across the width of the top bracket 90. The top bracket platform 92 receives abutment of the intermediate connector first stopper 81. The top bracket platform 92 is preferably rectangular and the top bracket 90 is also preferably generally rectangular.

It is also possible to reverse the piston so that the piston base 53 of the piston housing is connected to the piston connector 57 and the piston extension 54 is connected to the bottom bracket mounting rib 43. The ball joints can be substituted with a joint that has the same or greater degree of freedom. The swivel joints can be substituted with a joint having the same or greater degree of freedom. Thus, although the invention has been disclosed in detail with reference only to the preferred embodiments, those skilled in the art will appreciate that various other embodiments can be provided without departing from the scope of the invention. Accordingly, the invention is defined only by the claims set forth below.

The invention claimed is:

1. A door hinge comprising:

a. a bottom bracket for securing to a vehicle frame at a lower portion of a door hinge mounting;

b. a bottom bracket mounting rib extending from the bottom bracket;

c. a piston, wherein the piston has a piston housing and a piston extension connecting in telescopic connection to the piston housing, wherein the piston housing is connected to the bottom bracket at a bottom bracket mounting rib ball joint;

d. a piston connector, wherein the piston connector is connected to the piston extension at a tip of the piston extension;

e. a door bracket for mounting to a vehicle door, wherein the door bracket is connected to the piston connector at a door bracket extension, wherein the door bracket extension extends from the door bracket, wherein a connection between the door bracket extension and the piston connector is a door bracket extension ball joint;

f. an intermediate connector, wherein the intermediate connector is connected to the door bracket at an intermediate door bracket joint, wherein the intermediate door bracket joint is a swivel joint; and g. a top bracket for securing to a vehicle frame above the bottom bracket, wherein the top bracket is connected to the intermediate connector at a top bracket axle.

2. The door hinge of claim 1, further comprising:

a. a bottom bracket top bolt mount formed as a slot; and b. a bottom bracket bottom bolt mount formed as a slot, wherein the bottom bracket top bolt mount and bottom bracket bottom bolt mount are formed on the bottom bracket, wherein the bottom bracket mounting rib is rigidly connected to the bottom bracket between the bottom bracket top bolt mount and bottom bracket bottom bolt mount.

3. The door hinge of claim 1, further comprising:

a. a piston base extending from the piston housing, wherein the piston base extends through the bottom bracket mounting rib; and b. a piston base retainer securing the piston base to the bottom bracket mounting rib.

4. The door hinge of claim 3, further comprising:

a. a piston extension threading disposed on a tip of the piston extension;

b. wherein the piston connector tip is bent at an angle approximately normal to the piston connector.

5. The door hinge of claim 1, further comprising:

a. a door bracket flat face formed on the door bracket;

b. a door bracket top bolt mount; and c. a door bracket bottom bolt mount, wherein the door bracket flat face is between the door bracket top bolt mount and the door bracket bottom bolt mount.

6. The door hinge of claim 5, further comprising:

a. a door bracket platform protruding from the door bracket flat face;

b. a wedge shaped tip disposed on the door bracket platform.

7. The door hinge of claim 1, further comprising:

a. a top bracket platform formed on the top bracket;

b. an intermediate connector first stopper disposed on the intermediate connector, wherein the intermediate connector first stopper abuts the top bracket platform; and c. an intermediate connector second stopper disposed on an intermediate connector protrusion.

8. The door hinge of claim 7, further comprising:

a. an inside portion of the intermediate connector, wherein the intermediate connector first stopper is disposed on the inside portion of the intermediate connector; and b. an outside portion of the intermediate connector, wherein the intermediate connector protrusion extends from the outside portion of the intermediate connector.

9. The door hinge of claim 8, further comprising:

a. a first stopper axis of rotation; and b. a second stopper axis of rotation, wherein the first stopper axis of rotation is approximately perpendicular to the second stopper axis of rotation.

10. A door hinge comprising:

a. a bottom bracket for securing to a vehicle frame at a lower portion of a door hinge mounting;

b. a bottom bracket mounting rib extending from the bottom bracket at a bottom bracket mounting rib angle, wherein the bottom bracket mounting rib angle is approximately perpendicular to the bottom bracket;

c. a piston, wherein the piston has a piston housing and a piston extension connecting in telescopic connection to the piston housing, wherein the piston is connected to the bottom bracket at a bottom bracket mounting rib ball joint;

d. a piston connector, wherein the piston connector is connected to the piston;

e. a door bracket for mounting to a vehicle door, wherein the door bracket is connected to the piston connector at a door bracket extension, wherein the door bracket extension extends from the door bracket at a door bracket extension mounting angle, wherein the door bracket extension mounting angle is approximately perpendicular, wherein a connection between the door bracket extension and the piston connector is a door bracket extension ball joint;

f. an intermediate connector, wherein the intermediate connector is connected to the door bracket at an intermediate door bracket joint, wherein the intermediate door bracket joint is a swivel joint; and g. a top bracket for securing to a vehicle frame above the bottom bracket, wherein the top bracket is connected to the intermediate connector at a top bracket axle.

11. The door hinge of claim 10, further comprising:

a. a bottom bracket top bolt mount formed as a slot; and b. a bottom bracket bottom bolt mount formed as a slot, wherein the bottom bracket top bolt mount and bottom bracket bottom bolt mount are formed on the bottom bracket, wherein the bottom bracket mounting rib is rigidly connected to the bottom bracket between the bottom bracket top bolt mount and bottom bracket bottom bolt mount.

12. The door hinge of claim 10, further comprising:

a. a piston base extending from the piston housing, wherein the piston base extends through the bottom bracket mounting rib; and b. a piston base retainer securing the piston base to the bottom bracket mounting rib.

13. The door hinge of claim 12, further comprising:

a. a piston extension threading disposed on a tip of the piston extension;

b. wherein the piston connector tip is bent at an angle approximately normal to the piston connector.

14. The door hinge of claim 10, further comprising:

a. a door bracket flat face formed on the door bracket;

b. a door bracket top bolt mount; and c. a door bracket bottom bolt mount, wherein the door bracket flat face is between the door bracket top bolt mount and the door bracket bottom bolt mount.

15. The door hinge of claim 14, further comprising:

a. a door bracket platform protruding from the door bracket flat face;

b. a wedge shaped tip disposed on the door bracket platform.

16. The door hinge of claim 10, further comprising:

a. a top bracket platform formed on the top bracket;

b. an intermediate connector first stopper disposed on the intermediate connector, wherein the intermediate connector first stopper abuts the top bracket platform; and c. an intermediate connector second stopper disposed on an intermediate connector protrusion.

17. The door hinge of claim 16, further comprising:

a. an inside portion of the intermediate connector, wherein the intermediate connector first stopper is disposed on the inside portion of the intermediate connector; and b. an outside portion of the intermediate connector, wherein the intermediate connector protrusion extends from the outside portion of the intermediate connector.

18. The door hinge of claim 17, further comprising:

a. a first stopper axis of rotation; and b. a second stopper axis of rotation, wherein the first stopper axis of rotation is approximately perpendicular to the second stopper axis of rotation.

* * * * *